US007216448B2

(12) United States Patent
Hsu

(10) Patent No.: US 7,216,448 B2
(45) Date of Patent: May 15, 2007

(54) DISPLAY FRAME FOR A FLAT PANEL DEVICE

(76) Inventor: Tsung-Han Hsu, No. 300, Nan-Hsing St., Nan-Hsing Tsun, Kuei-Jen Hsiang, Tainan Hsien (TW)

( * ) Notice: Subject to any disclaimer, the term of this patent is extended or adjusted under 35 U.S.C. 154(b) by 333 days.

(21) Appl. No.: 10/785,849

(22) Filed: Feb. 24, 2004

(65) Prior Publication Data

US 2004/0163294 A1 Aug. 26, 2004

(30) Foreign Application Priority Data

Feb. 26, 2003 (TW) ..... 92203002 U

(51) Int. Cl.
*A47G 1/06* (2006.01)
*A47B 88/00* (2006.01)

(52) U.S. Cl. ..... 40/725; 40/740; 312/310; 312/319.1

(58) Field of Classification Search ..... 40/739, 40/740, 794; 312/212, 242, 245, 310, 319.1; 348/836

See application file for complete search history.

(56) References Cited

U.S. PATENT DOCUMENTS

| | | | | | |
|---|---|---|---|---|---|
| 605,959 | A * | 6/1898 | Henderson | 248/451 |
| 1,388,010 | A * | 8/1921 | Watson | 40/721 |
| RE33,443 | E * | 11/1990 | Ackeret | 40/721 |
| 6,156,465 | A * | 12/2000 | Cao et al. | 430/30 |
| 6,874,645 | B2 * | 4/2005 | Broderick | 211/40 |

* cited by examiner

*Primary Examiner*—Cassadndra Davis
(74) *Attorney, Agent, or Firm*—Grossman Tucker Perreault & Pfleger, PLLC

(57) ABSTRACT

A display frame includes a frame body defining a receiving space with an access opening facing forwardly, a holding tray adapted for holding a flat panel device, like a tablet PC, and movable relative to the frame body between an extending position where the holding tray extends forwardly and outwardly of the opening, and a retreat position where the holding tray retreats into the space, a front profile frame movable relative to the frame body between open and closed positions, and a linkage pivoted on the front profile frame and coupled to a key which is disposed on the holding tray such that when the linkage is moved in response to the movement of the front profile frame, the holding tray is moved between the extending and retreat positions.

12 Claims, 21 Drawing Sheets

DISPLAY FRAME FOR A FLAT PANEL DEVICE

CROSS-REFERENCE TO RELATED APPLICATION

This application claims priority of Taiwanese Application No. 092203002, filed on Feb. 26, 2003.

BACKGROUND OF THE INVENTION

1. Field of the Invention

This invention relates to a display frame, more particularly to a display frame adapted to be mounted on a support, such as an upright wall, a display stand, or the like for holding a flat panel device and a picture.

2. Description of the Related Art

Conventional picture frames are suspended on a wall for displaying photographs or paintings received therein. On the other hand, the recent development of flat panel systems, such as tablet PCs, has made presentation of multimedia data more convenient. Therefore, it is desirable to provide a display frame in the form of a picture frame for holding a flat panel electronic device in an upright state for presentation of multimedia data to an audience.

SUMMARY OF THE INVENTION

The object of the present invention is to provide a display frame which can hold a framed picture or a flat panel electronic device and which can be mounted on a support for presentation of multimedia data to an audience.

According to this invention, the display frame is adapted for holding a framed picture and a flat panel device and for mounting to a support. The display frame includes a frame body including a rear wall, and right and left walls which extend in an upright direction and which are disposed opposite to each other in a longitudinal direction transverse to the upright direction to define a receiving space therebetween. The receiving space has an access opening which is opposite to the rear wall in the transverse direction and which faces forwardly and in a transverse direction relative to the upright and longitudinal directions. A backing member is adapted for holding the flat panel device, is received in the receiving space, and is movable relative to the rear wall of the frame body in the transverse direction. A front profile frame has a viewing window, and is disposed to be movable relative to the frame body between an open position, where the viewing window is remote from the access opening to permit placement of the flat panel device to the backing member, and a closed position, where the viewing window is close to the access opening so as to cover the access opening. A biasing member is disposed to bias the backing member away from the rear wall.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
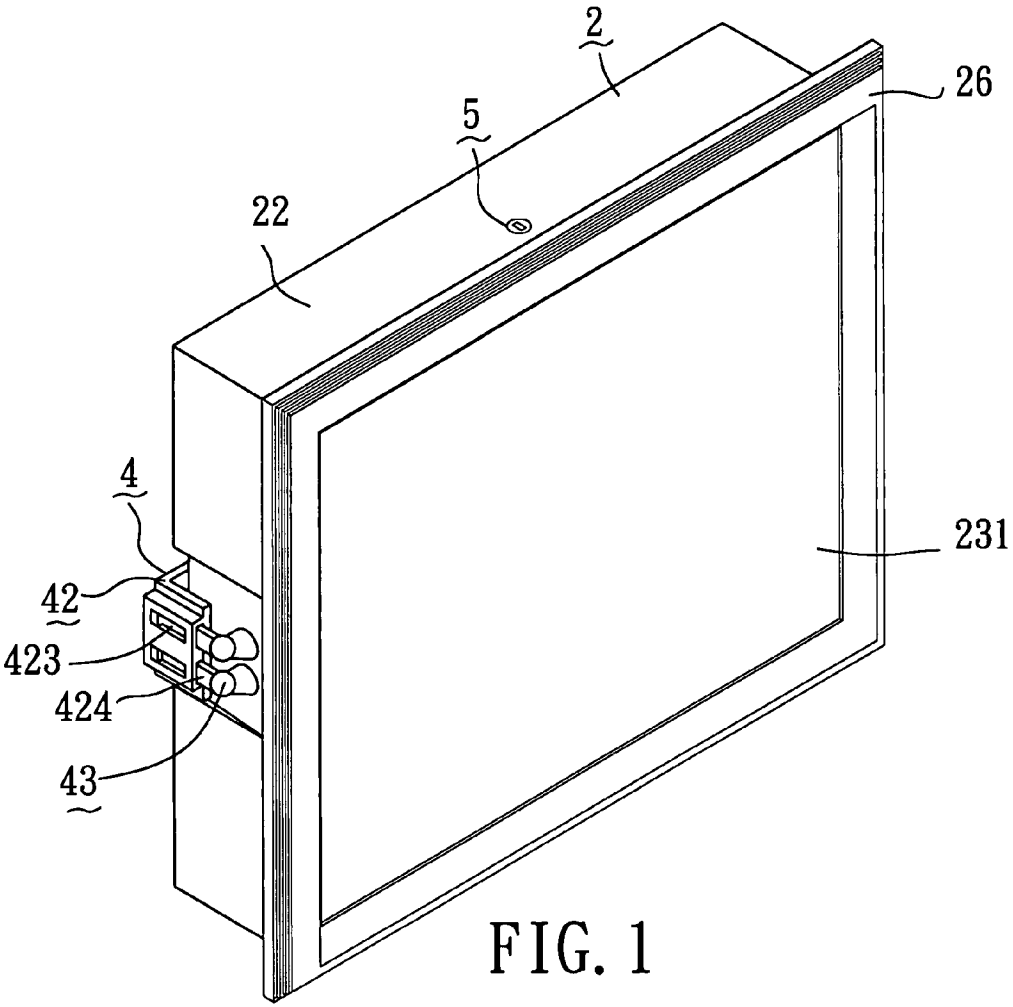
FIG. 1 is a perspective view of a first preferred embodiment of a display frame according to this invention.

Before the present invention is described in greater detail, it should be noted that same reference numerals have been used to denote like elements throughout the specification.

Referring to FIGS. 1 to 4, the first preferred embodiment of a display frame according to the present invention is adapted to hold a framed picture 11 and a flat panel device 12, such as a tablet PC (see FIGS. 4 and 5), and to be mounted to a support, such as an upright wall, a display stand, and the like. The display frame of this embodiment is shown to comprise a frame body 2, a front profile frame 23, a pair of linking units 25, a holding unit 3, a locking unit 5, and a fastening unit 4.

The frame body 2 includes a rear wall 21 with four through holes 211 therein, a surrounding wall 22 which extends from the rear wall 21 in a transverse direction and which includes right and left walls 222,221 opposite to each other in a longitudinal direction transverse to the transverse direction, and upper and lower walls 223,224 opposite to each other in an upright direction transverse to the longitudinal and transverse directions so as to define a receiving space 24 with an access opening which is opposite to the rear wall 21 and which faces forwardly and in the transverse direction.

Figure 6:
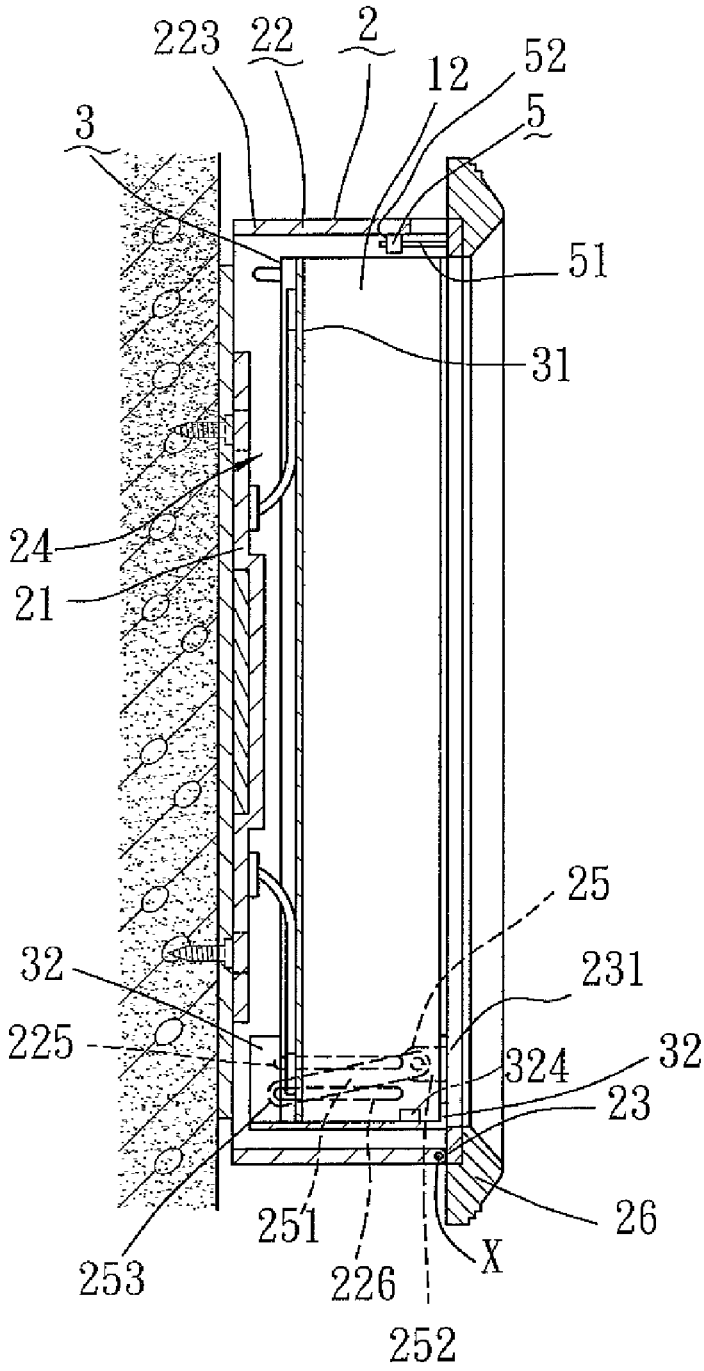
FIG. 6 is a sectional side view of the first preferred embodiment in a closed state.

The front profile frame 23 has a proximate end 232 which is mounted pivotally on the lower wall 224 about a first pivoting axis (X) such that a distal end 233 thereof is turnable about the first pivoting axis (X) between an open position, where a viewing window 231 of the front profile frame 23 that is disposed between the proximate and distal ends 232,233 is remote from the access opening to permit placement of the flat panel device 12 in the receiving space 24, and a closed position, where the viewing window 231 is close to the access opening so as to cover the access opening (see FIG. 6). A decorative frame 26 is detachably mounted on a front surface of the front profile frame 23.

Each of the linking units 25 includes a pivot mount 252 which is mounted on the front profile frame 23 proximate to the proximate end 232 and which extends to terminate at an anchor end distal from the viewing window 231. A linkage 251, in the form of a lever, has a pivot end 2511 which is pivotally mounted on the anchor end of the pivot mount 252 about a pivot axis, and a connecting end 2512 which is opposite to the pivot end in a radial direction relative to the pivot axis and which is turnable between first and second positions that correspond to the open and closed positions of the front profile frame 23, respectively.

The holding unit 3 includes a holding tray 32, a backing member 31, and two biasing members 33. The holding tray 32 is adapted to be disposed underneath a bottom wall of the flat panel device 12, and is disposed to be movable relative to the frame body 2 in the transverse direction between an extending position, where the holding tray 32 extends forwardly and outwardly of the access opening, and a retreat position, where the holding tray 32 retreats into the receiving space 24. In particular, a keyway 226, in the form of a slot, is formed in each of the right and left walls 222,221, and is elongated in the transverse direction. A key 253 is disposed on the holding tray 32, and has an intermediate portion extending from the holding tray 32 in the longitudinal direction to terminate at a coupling end. The intermediate portion of the key 253 is inserted into and is slidable relative to the keyway 226 so as to move the holding tray 32 between the extending and retreat positions. Preferably, lower right and left sliding pins 254 are respectively disposed on right and left sides of the holding tray 32, and extend respectively towards the right-and left walls 222,221 so as to be slidable along lower sliding slots 225 formed respectively in the right and left walls 222,221 and extending in the transverse direction, thereby stabilizing the movement of the holding tray 32. In addition, the holding tray 32 includes a front barrier wall 321 which confronts and which is disposed distal from the rear wall 21. An electrical connecting unit 324 is disposed under the holding tray 32 for electrical connection with the flat panel device 12.

Moreover, the connecting end 2512 of the linkage 251 has an inner peripheral bearing wall which defines a hole and which has the coupling end of the key 253 journalled thereon so as to serve as a coupling member. As such, when the connecting end 2512 of the linkage 251 is moved between the first and second positions, the holding tray 32 is moved between the extending and retreat positions, respectively. Besides, pivotal connection of the proximate end 232 of the front profile frame 23 with the lower wall 224 of the frame body 2 about the first pivoting axis (X) enables stabilized angular movement of the connecting end 2512 of the linkage 251.

Figure 2:
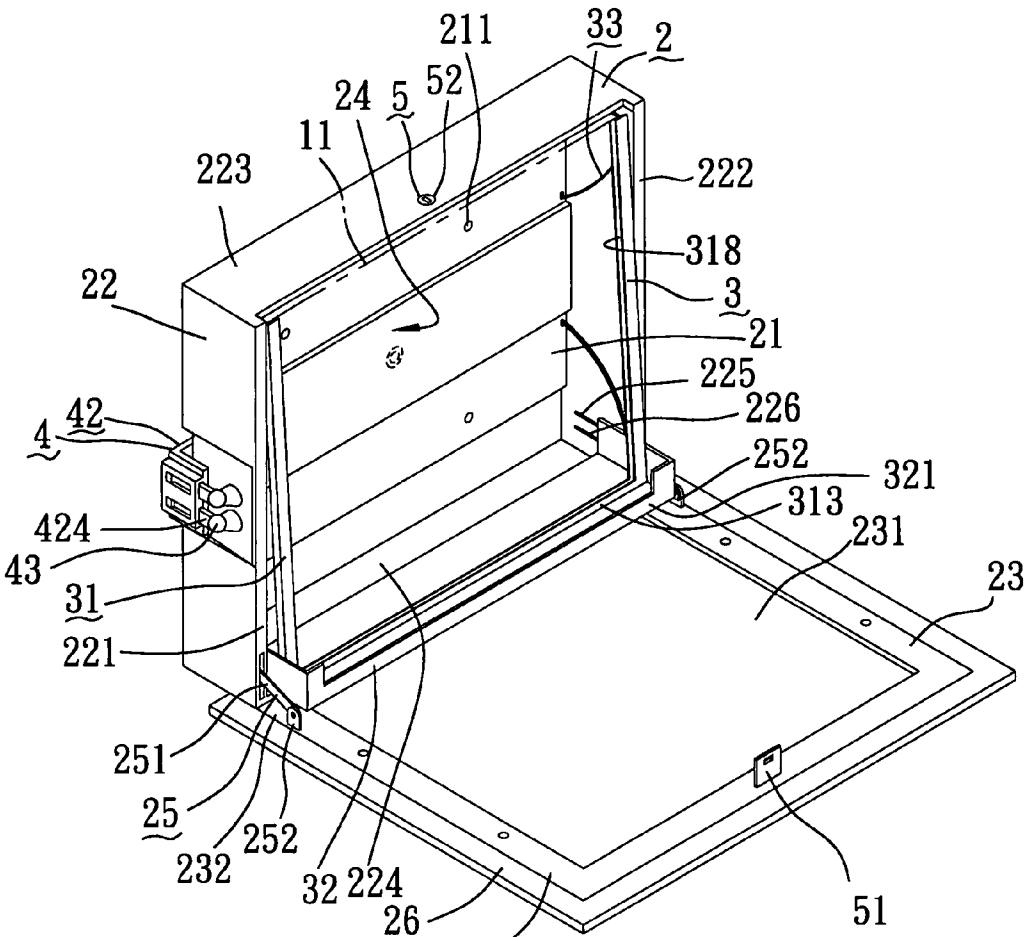
FIG. 2 is a perspective view of the first preferred embodiment in an opened state.
Figure 4:
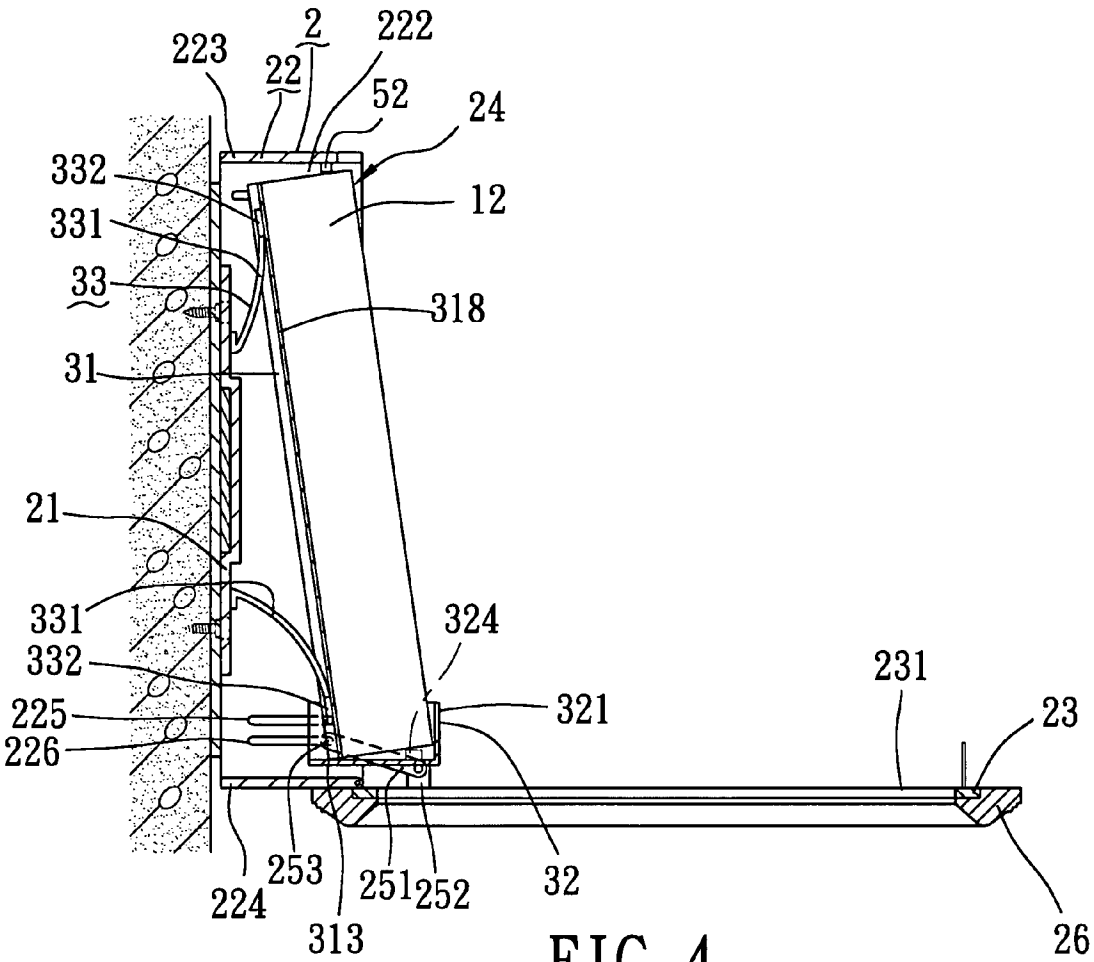
FIG. 4 is a sectional side view of the first preferred embodiment in the opened state, with a flat panel device placed thereon.
Figure 5:
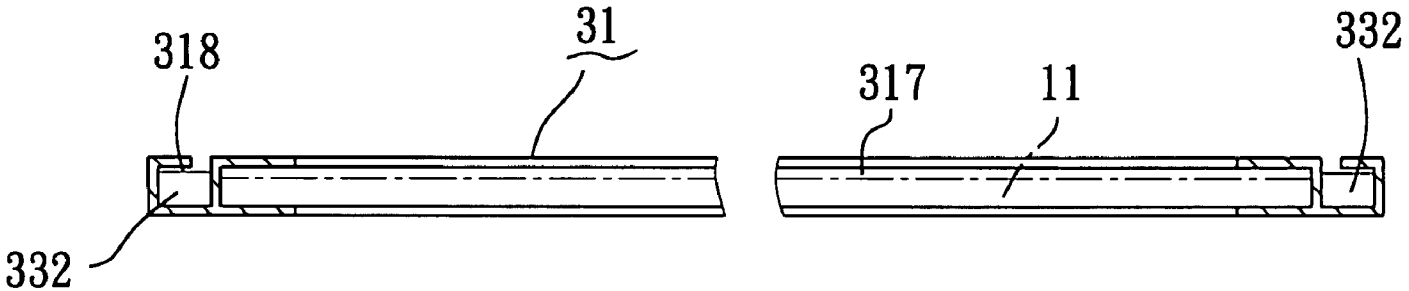
FIG. 5 is a top view of a backing member of the display frame of the first preferred embodiment.

The backing member 31 includes a lower abutment portion 313 which is spaced apart from the front barrier wall 321 of the holding tray 32 in the transverse direction and which is slidable on the holding tray 32 to adjust the distance between the lower abutment portion 313 and the front barrier wall 321 so as to accommodate the thickness of the bottom wall of the flat panel device 12 and so as to permit abutment of the flat panel device 12 thereagainst (see FIG. 4). With reference to FIGS. 2 and 5, the backing member 31 defines an inserting space 317 for insertion of the framed picture 11 therein, and two sliding slots 318 extending in the upright direction.

Furthermore, two upper right and left sliding plates 34 are disposed pivotally and respectively on right and left sides of the backing member 31, and extend respectively towards the right and left walls 222,221 so as to be slidable along upper sliding slots 227 formed respectively in the right and left walls 222,221 and extending in the transverse direction, thereby stabilizing the movement of the backing member 31.

Figure 3:
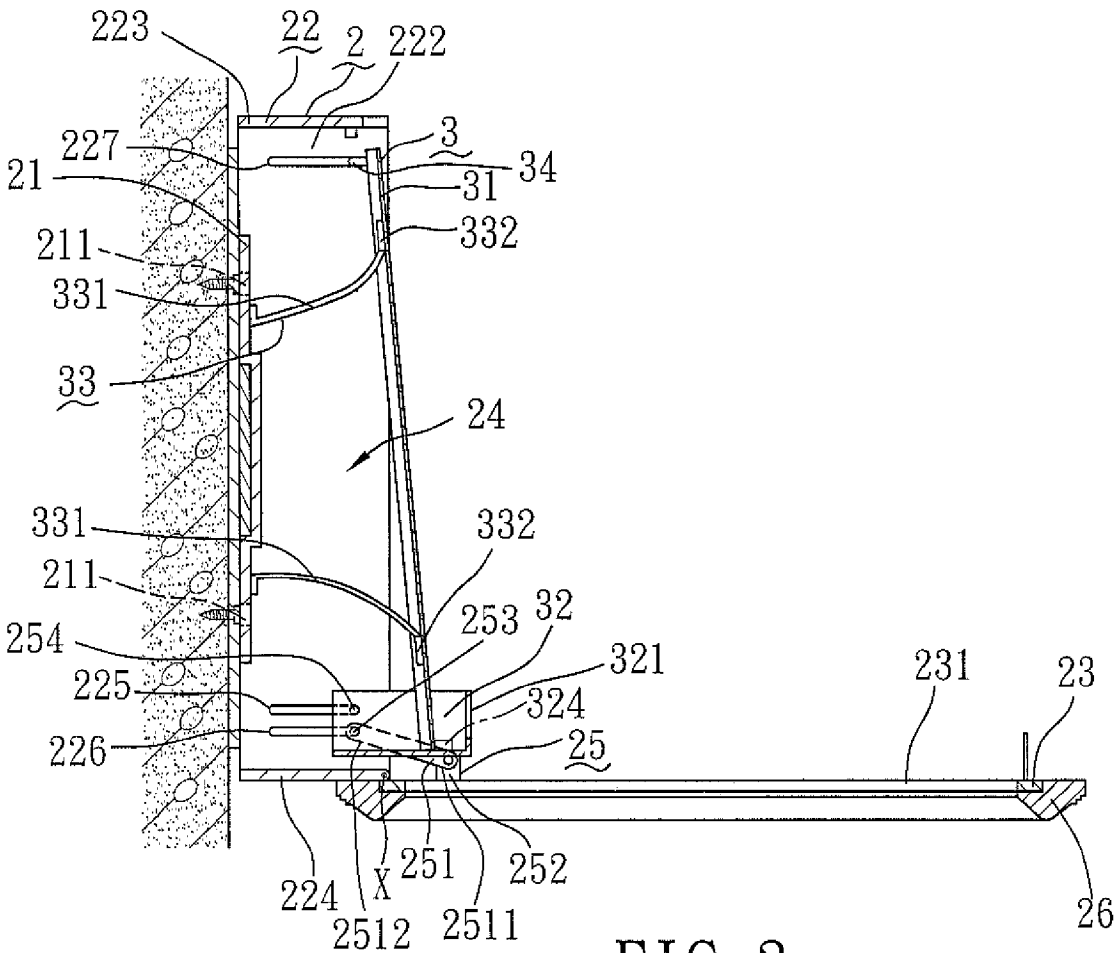
FIG. 3 is a sectional side view of the first preferred embodiment in the opened state.

Referring to FIGS. 3 and 5, each of the biasing members 33 includes two leaf springs 331, each of which has two ends secured on the rear wall 21, and respectively provided with sliding blocks 332. The sliding blocks 332 are slidably inserted into the sliding slots 318 in the backing member 31 such that the backing member 31 is biased by the biasing members 33 towards the front barrier wall 321 of the holding tray 32, thereby retaining the bottom wall of the flat panel device 12 between the lower abutment portion 313 of the backing member 31 and the front barrier wall 321.

Referring to FIGS. 2 and 6, the locking unit 5 includes locking and locked portions 51,52 which are respectively disposed on the distal end 233 of the front profile frame 23 and the upper wall 223 of the frame body 2, and which are engaged with each other so as to fasten the front profile frame 23 to the frame body 2 in the closed position.

In use, referring to FIGS. 3 and 4, when the front profile frame 23 is in the open position, the flat panel device 12 is placed on the holding tray 32, and the bottom wall thereof is retained between the front barrier wall 321 and the lower abutment portion 313 of the backing member 31, such that the backing member 31 is inclined rearwardly towards the rear wall 21. Referring to FIG. 6, the front profile frame 23 is then moved from the open position to the closed position such that the holding tray 32 is moved to the retreat position, where the holding tray 32 retreats into the receiving space 24 by means of the linking units 25. The front profile frame 23 is subsequently fastened to the frame body 2 by the locking unit 5. Thus, the flat panel device 12 can be held in the display frame for presentation of multimedia data through the viewing window 231. Besides, when the locking unit 5 is released, and the front profile frame 23 is moved from the closed position to the open position, the holding tray 32 can be moved to the extending position by the biasing members 33 for facilitating removal of the flat panel device 12 from the receiving space 24.

Figure 7:
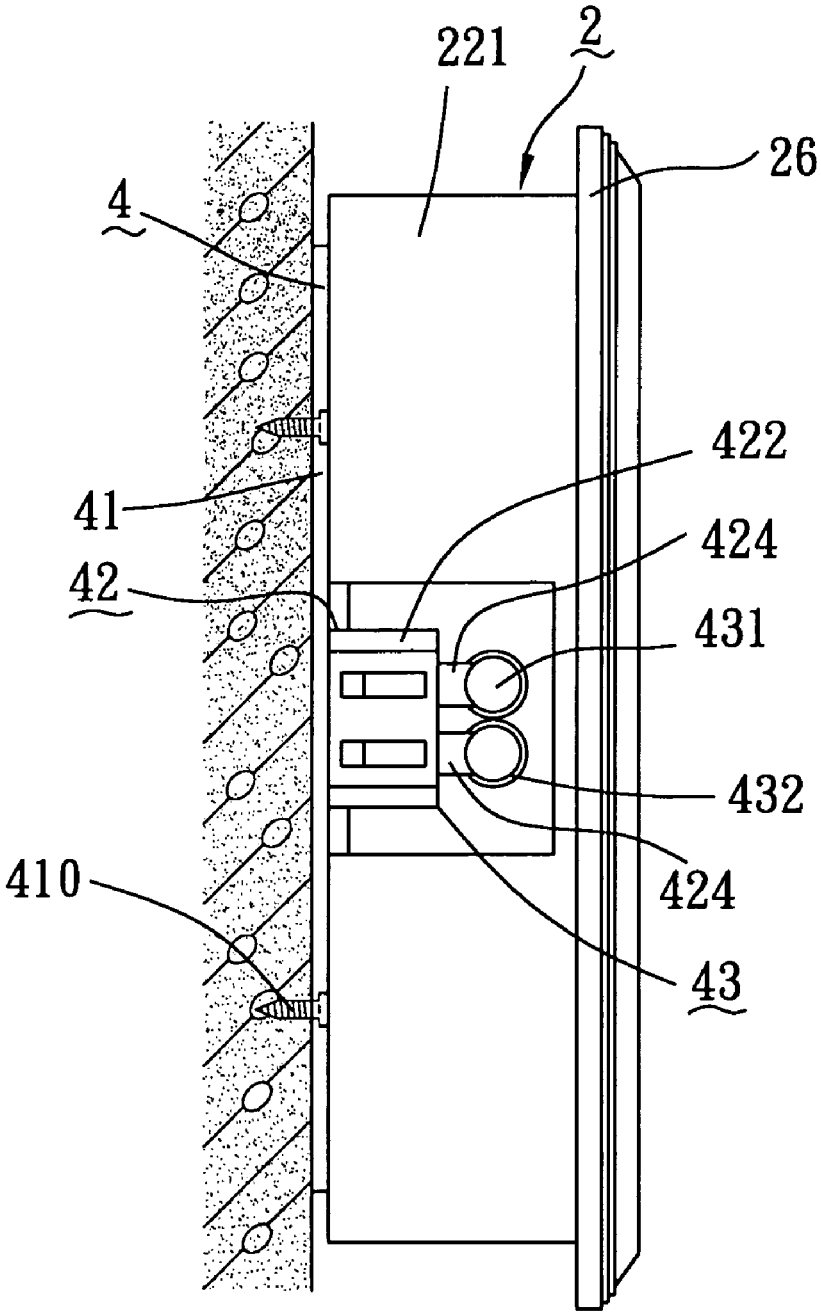
FIG. 7 is a side view of the first preferred embodiment in the closed state.
Figure 8:
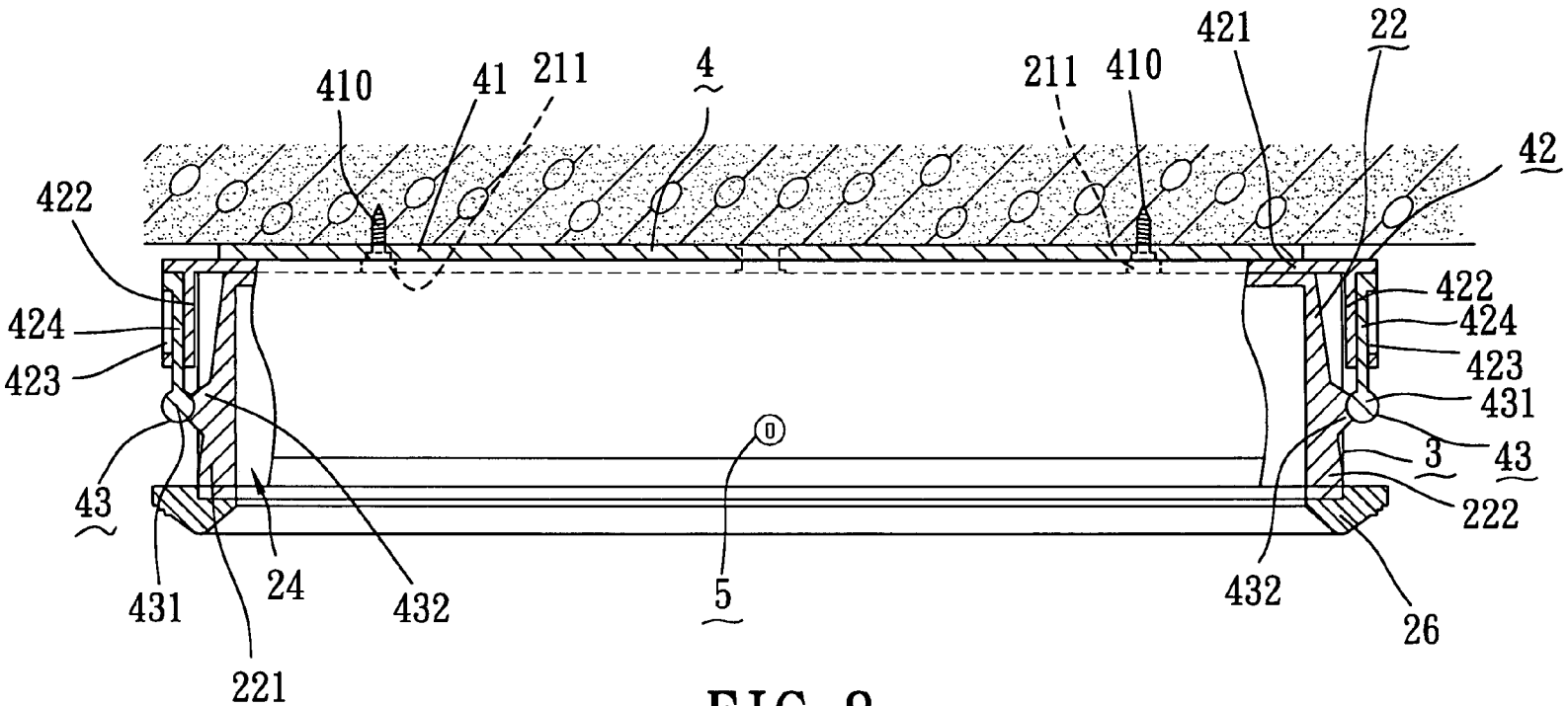
FIG. 8 is a cross-sectional view of the first preferred embodiment in the closed state.
Figure 9:
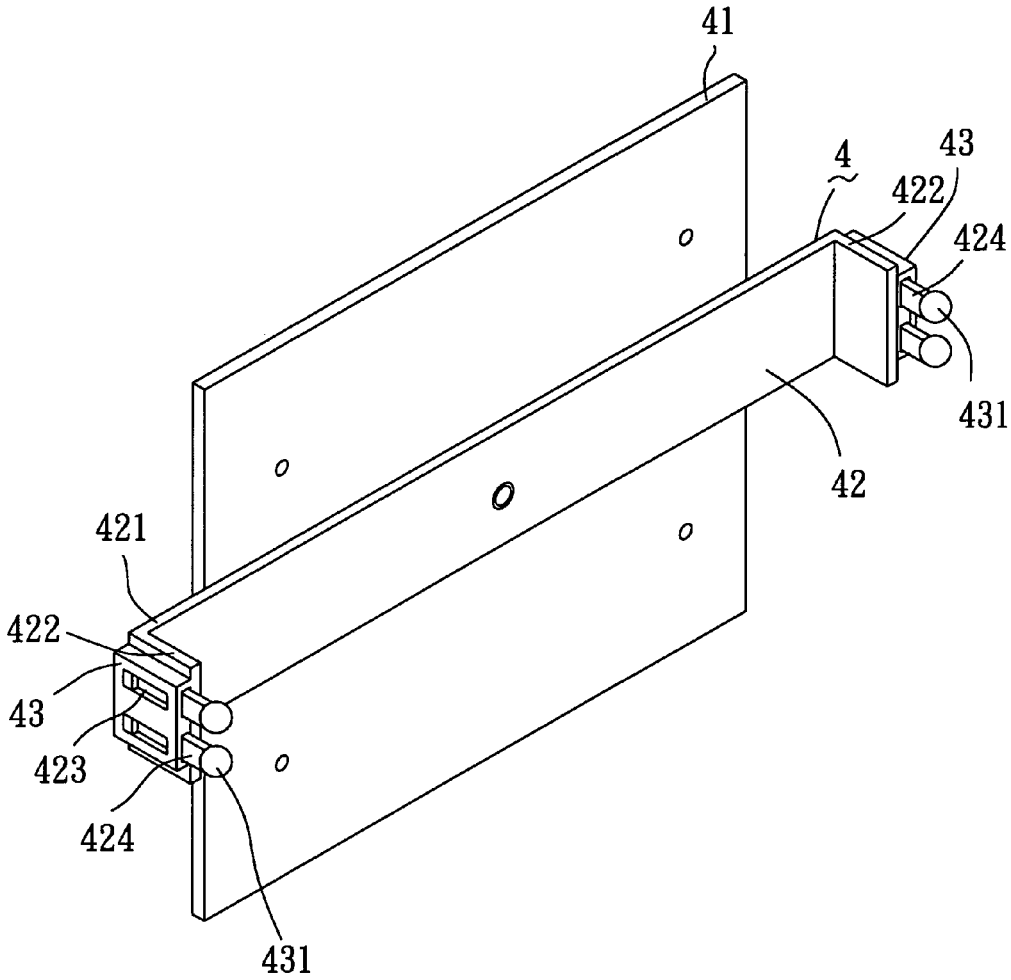
FIG. 9 is a perspective view of a fastening unit of the display frame of the first preferred embodiment.

Referring to FIGS. 7 to 9, the fastening unit 4 includes a baseplate 41, a connecting frame 42, and right and left interengaging members 43. The baseplate 41 is adapted to be secured to the support, such as a wall, by screw bolts 410, and has right and left ends which are disposed proximate to the right and left walls 222,221, respectively. The connecting frame 42 includes right and left arms 422 which extend in the transverse direction opposite to the baseplate 41, and which confront the right and left walls 222,221 in the longitudinal direction, respectively, and an intermediate plate 421 which extends in the longitudinal direction and which interconnects the right and left arms 422. The intermediate plate 421 is disposed forwardly of and is mounted pivotally on the baseplate 41 about a rotating axis in the transverse direction such that the right and left arms 422 are turnable about the rotating axis relative to the baseplate 41. Each of the right and left interengaging members 43 includes two latch holes 423 which are formed in a respective one of the right and left arms 422, two latches 424, each of which has a retained portion retainingly slidable relative to a respective one of the latch holes 423, and a joining portion extending outwardly of the respective latch hole 423, and two ball joints, each of which includes a male piece 431 formed on the joining portion of the respective latch 424, and a female piece 432 formed on a respective one of the right and left walls 222,221 so as to permit turning of the frame body 2 relative to the baseplate 41.

Figure 10:
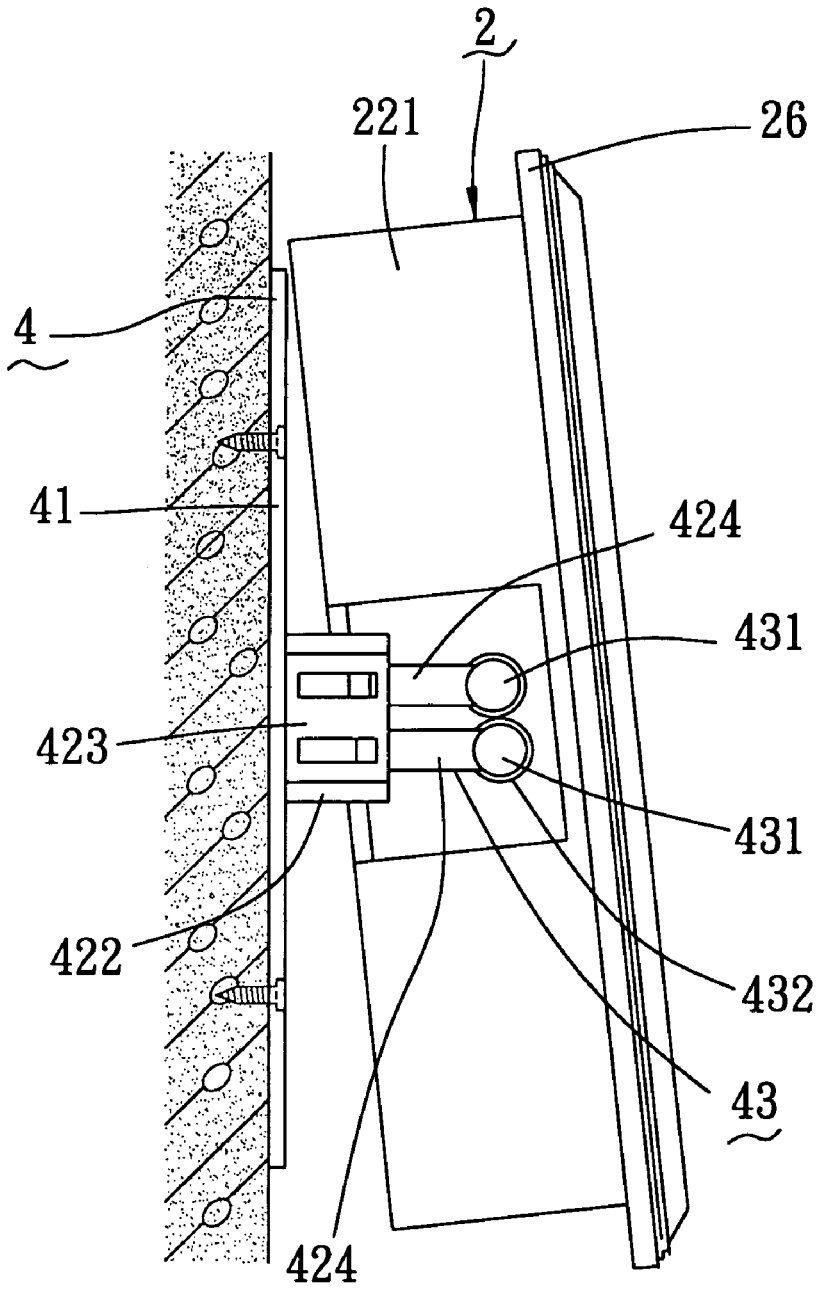
FIG. 10 is a side view of the first preferred embodiment in a first tilted state.

In view of the foregoing, adjustment of inclination of the frame body 2 relative to the support so as to adjust the viewing angle of the flat panel device 12 can be performed as follows:

1. Referring to FIG. 10, when the latches 424 on one of the right and left arms 422 are operated, the frame body 2 can be tilted upward or downward.

Figure 11:
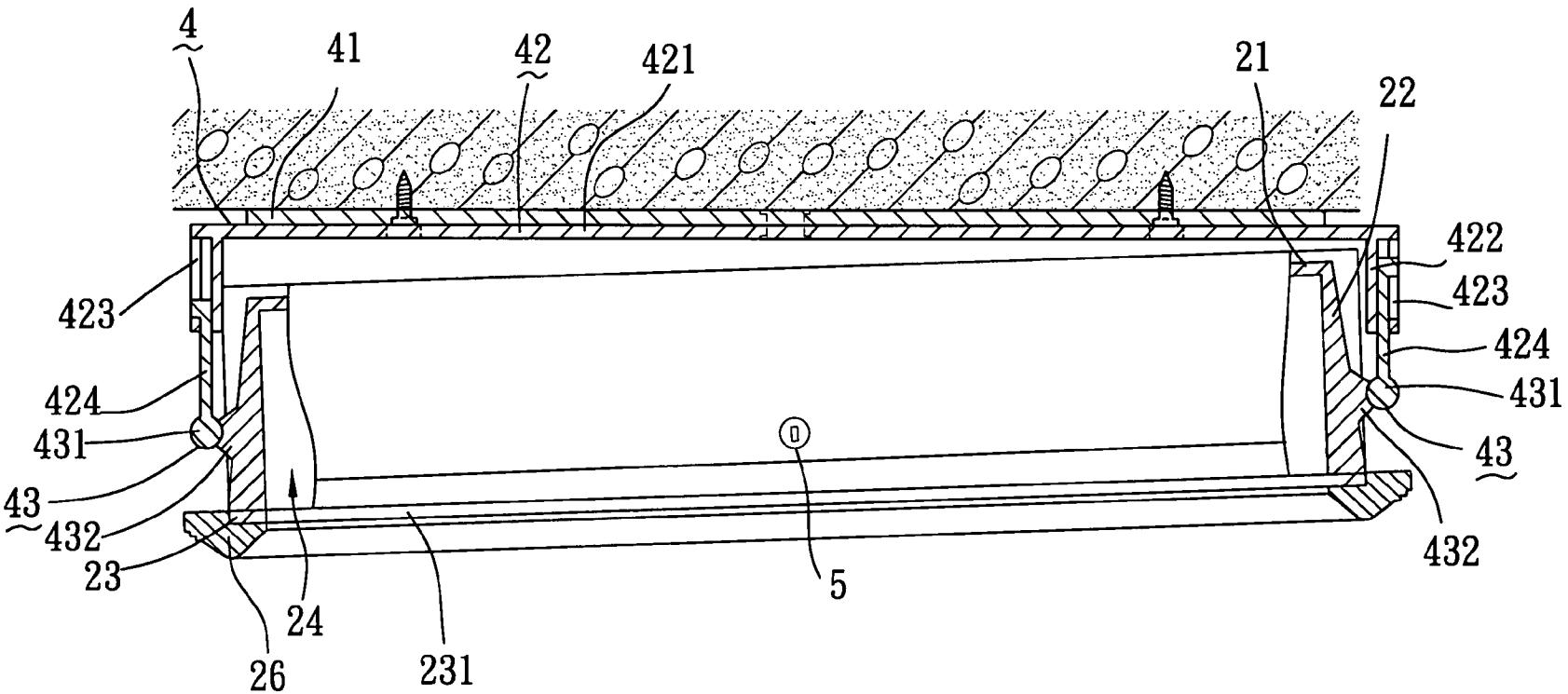
FIG. 11 is a cross-sectional view of the first preferred embodiment in a second tilted state.

2. Referring to FIG. 11, when the latches 424 on both the right and left arms 422 are moved, the frame body 2 can be rotated leftward or rightward.

Figure 12:
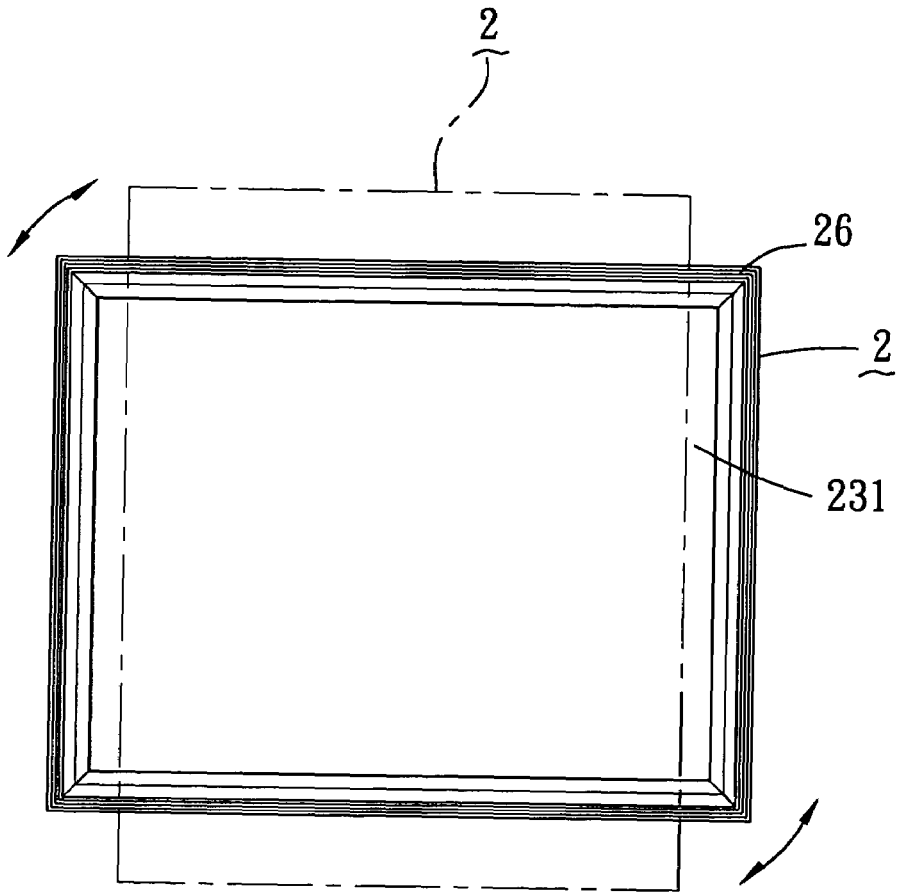
FIG. 12 is a schematic view illustrating how the first preferred embodiment can be turned to an angle of 90.

3. Referring to FIGS. 9 and 12, when the connecting frame 42 is turned relative to the baseplate 41, the frame body 2 can be rotated.

Figure 13:
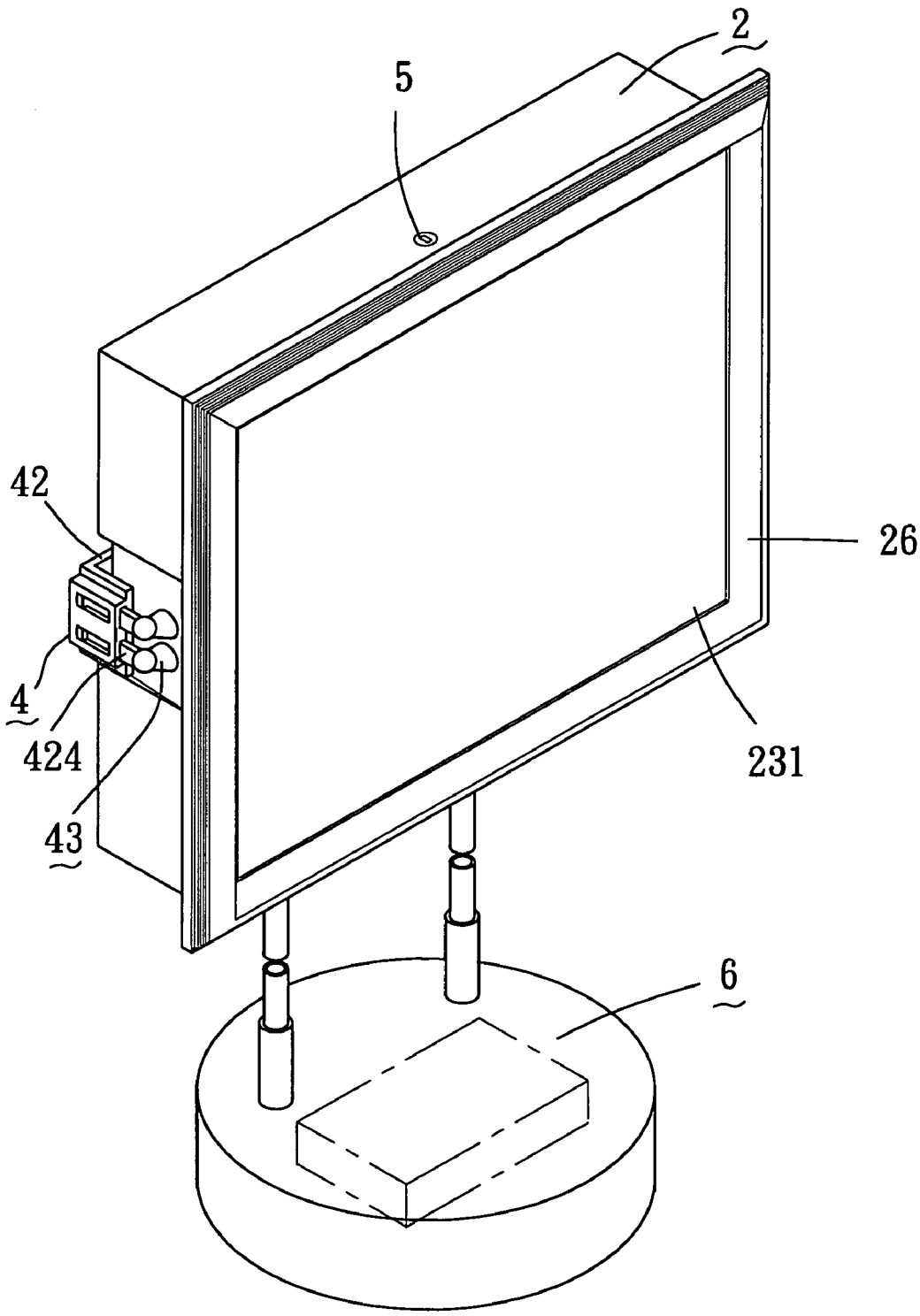
FIG. 13 is a perspective view of the first preferred embodiment held on a display stand.

As shown in FIG. 13, the display frame of this invention can also be held on a display stand 6.

Figure 14:
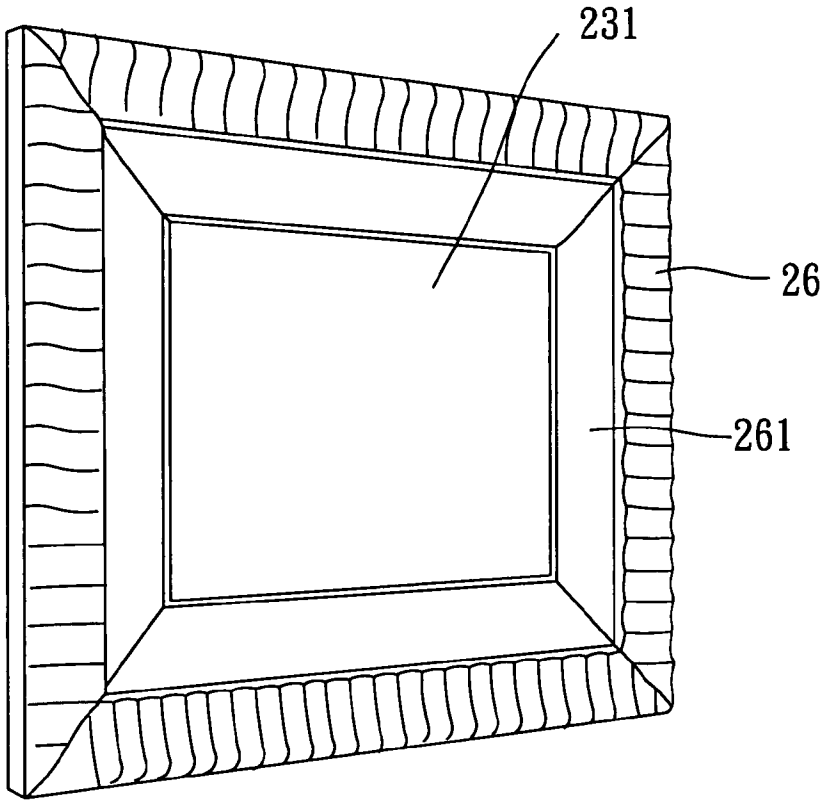
FIG. 14 is a perspective view of a second preferred embodiment of a display frame according to this invention.
Figure 15:
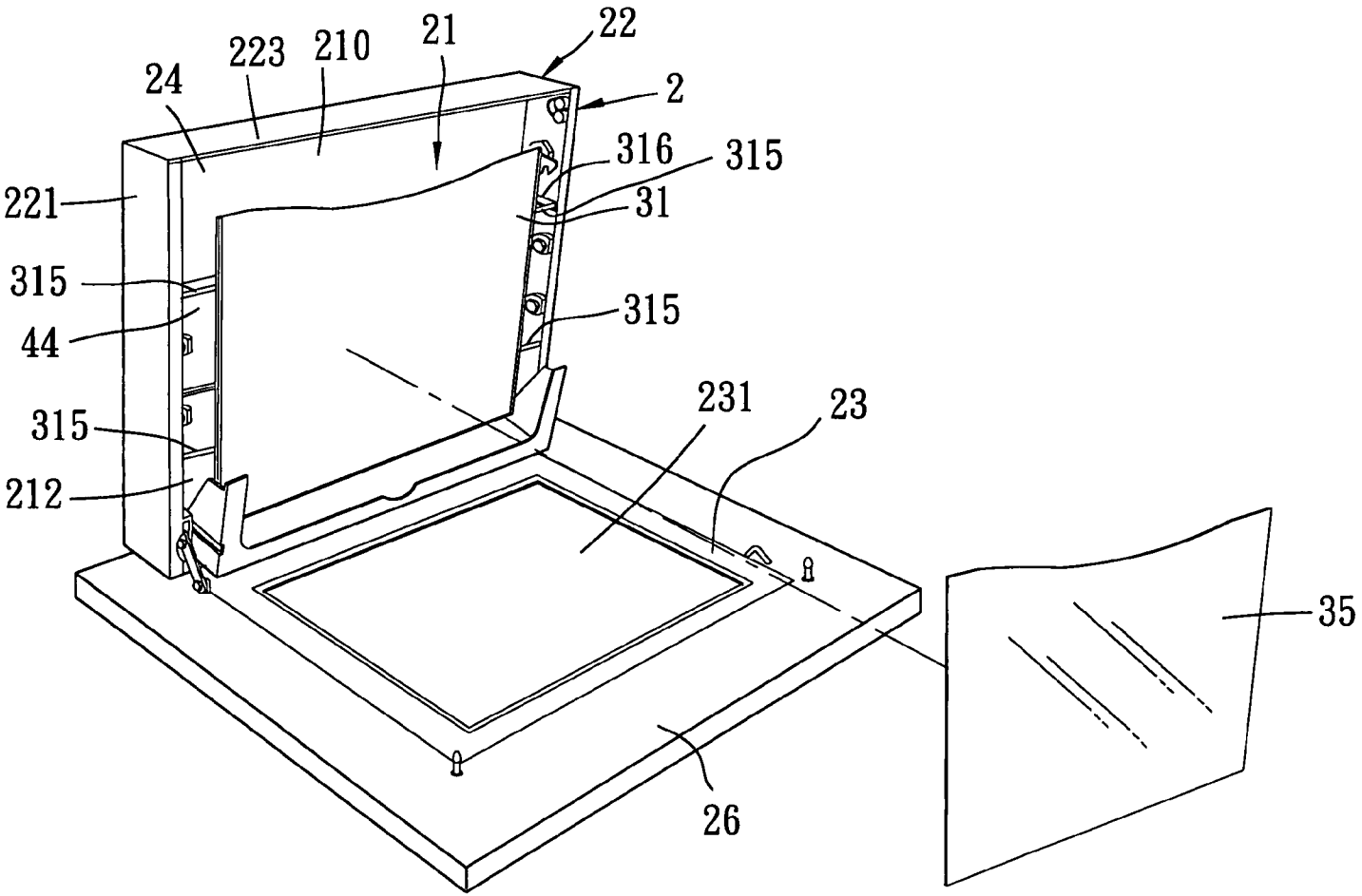
FIGS. 15 and 16 are fragmentary exploded perspective views of the second preferred embodiment.
Figure 16:
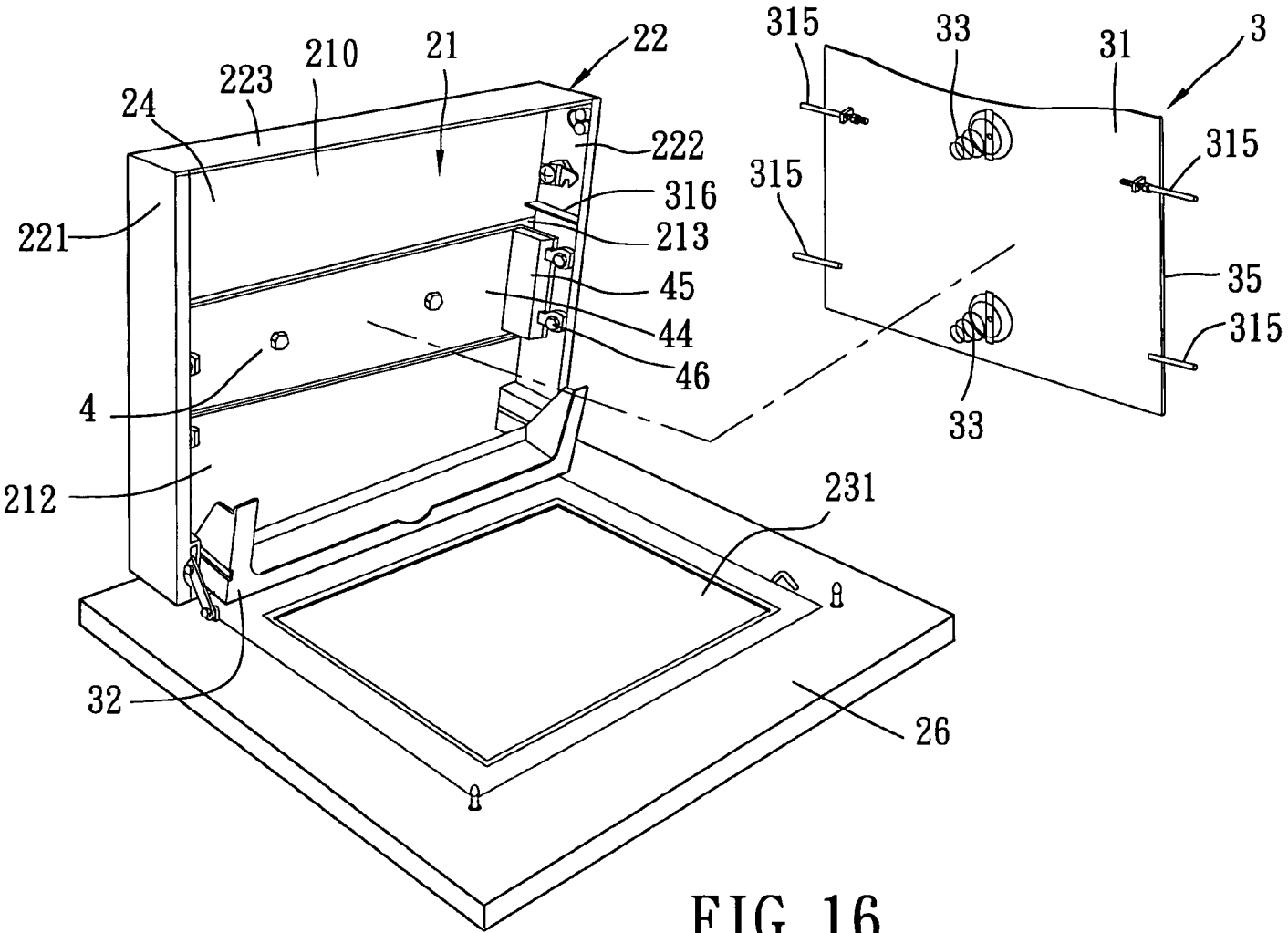

Referring to FIGS. 14 to 16, the second preferred embodiment of a display frame according to this invention is shown to be similar to the previous embodiment. In this embodiment, the decorative frame 26 has an inner peripheral edge 261 for shielding an outer periphery of the flat panel device (not shown). The rear wall 21 of the frame body 2 has upper and lower wall portions 210,212 which are spaced apart from each other to define an opening 213 therebetween. The fastening unit 4 includes a baseplate 44 which is adapted to be secured to an upright wall and which is disposed in the opening 213, and right and left arms 45 which extend integrally and respectively from two sides of the baseplate 44, and which are respectively engaged with the right and left walls 222,221 of the frame body 2 through an interengaging member which is in the form of a latch-and-latch hole assembly 46. In addition, a plastic transparent sheet 35 is disposed forwardly of and is spaced apart from the backing member 31 to confine an inserting space therebetween for receiving a framed picture (not shown). The biasing members 33 are in the form of two springs. Two pairs of right and left sliding shafts 315 are respectively disposed on the right and left sides of the backing member 31, and are respectively slidable along two pairs of right and left rails 316 which are respectively disposed on the right and left walls 222,221 to permit movement of the backing member 31 relative to the holding tray 32.

Figure 17:
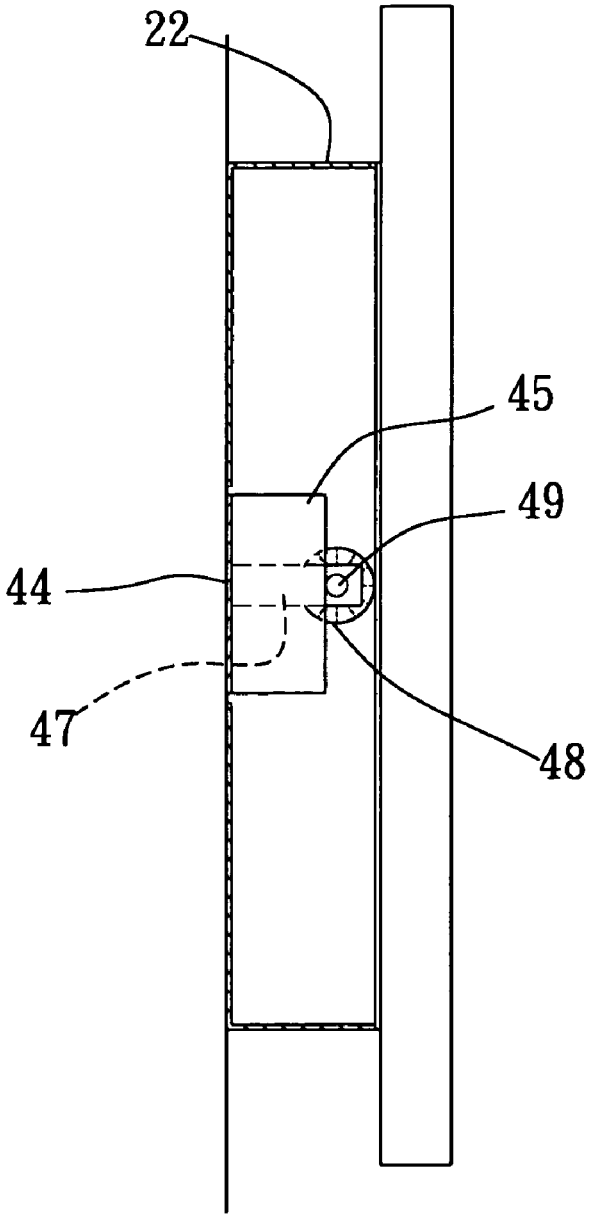
FIG. 17 is a sectional side view of a third preferred embodiment of a display frame according to this invention.
Figure 18:
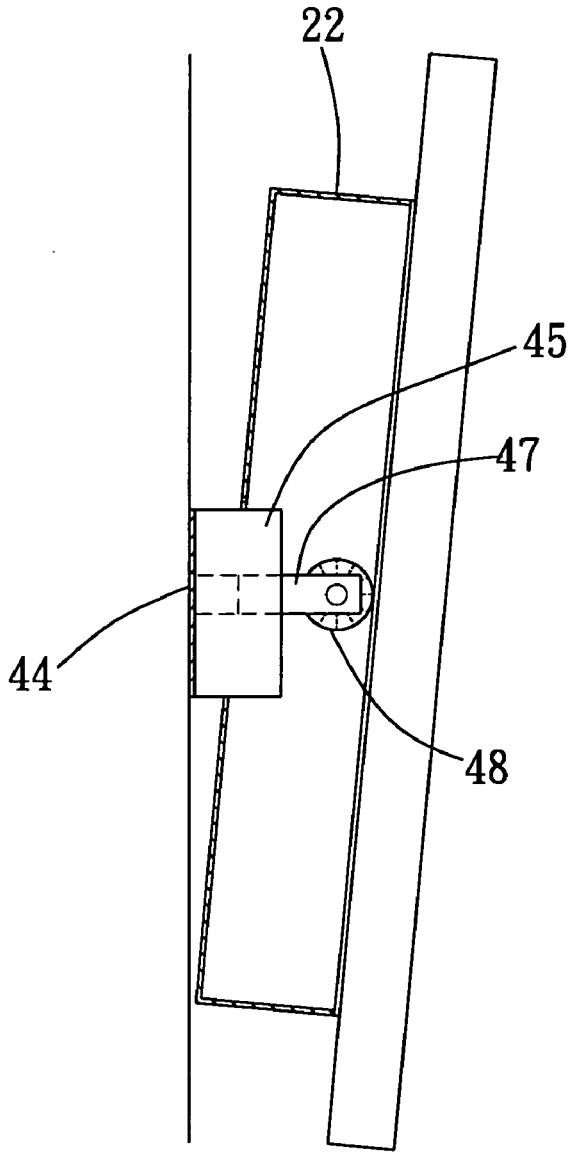
FIG. 18 is a sectional side view of the third preferred embodiment in a tilted state.

Referring to FIGS. 17 and 18, the third preferred embodiment of a display frame according to this invention is shown to be similar to the second embodiment, except that each of the right and left interengaging members includes a telescopic shaft 47 which is mounted on a respective one of the right and left arms 45, and a friction rotary member 48 including two friction plates which are respectively disposed on the telescopic shaft 47 and the respective one of the right and left walls of the surrounding wall 22 and which are frictionally retained to each other by a screw fastener 49 so as to permit frictional turning of the frame body 2 relative to the baseplate 44.

Figure 19:
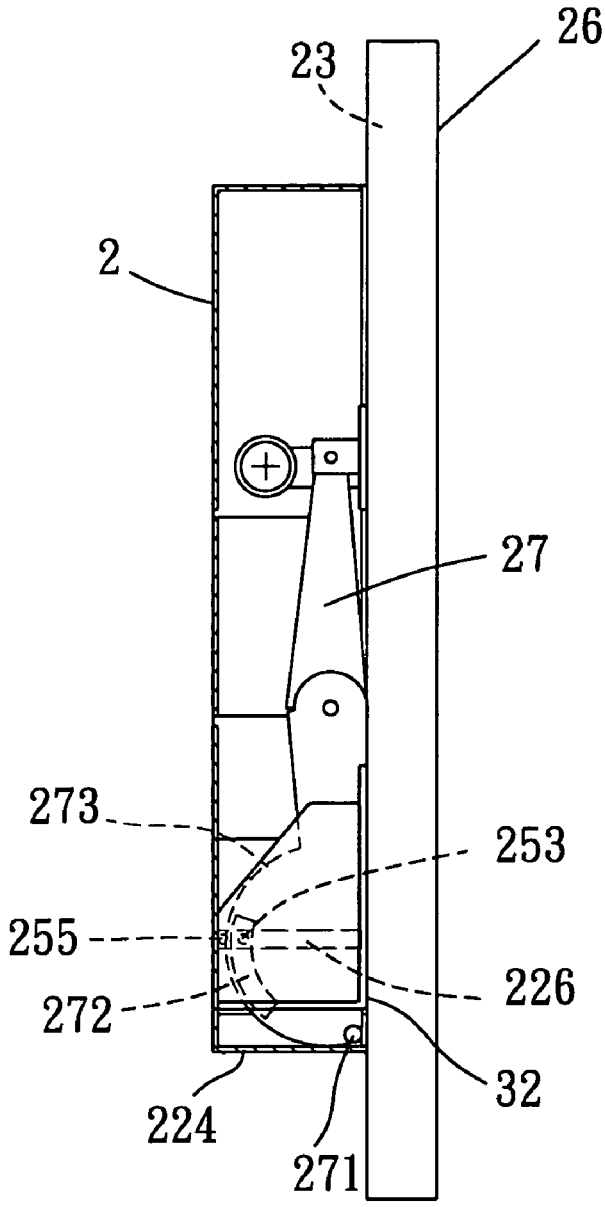
FIG. 19 is a sectional side view of a fourth preferred embodiment of a display frame according to this invention in a closed state.
Figure 20:
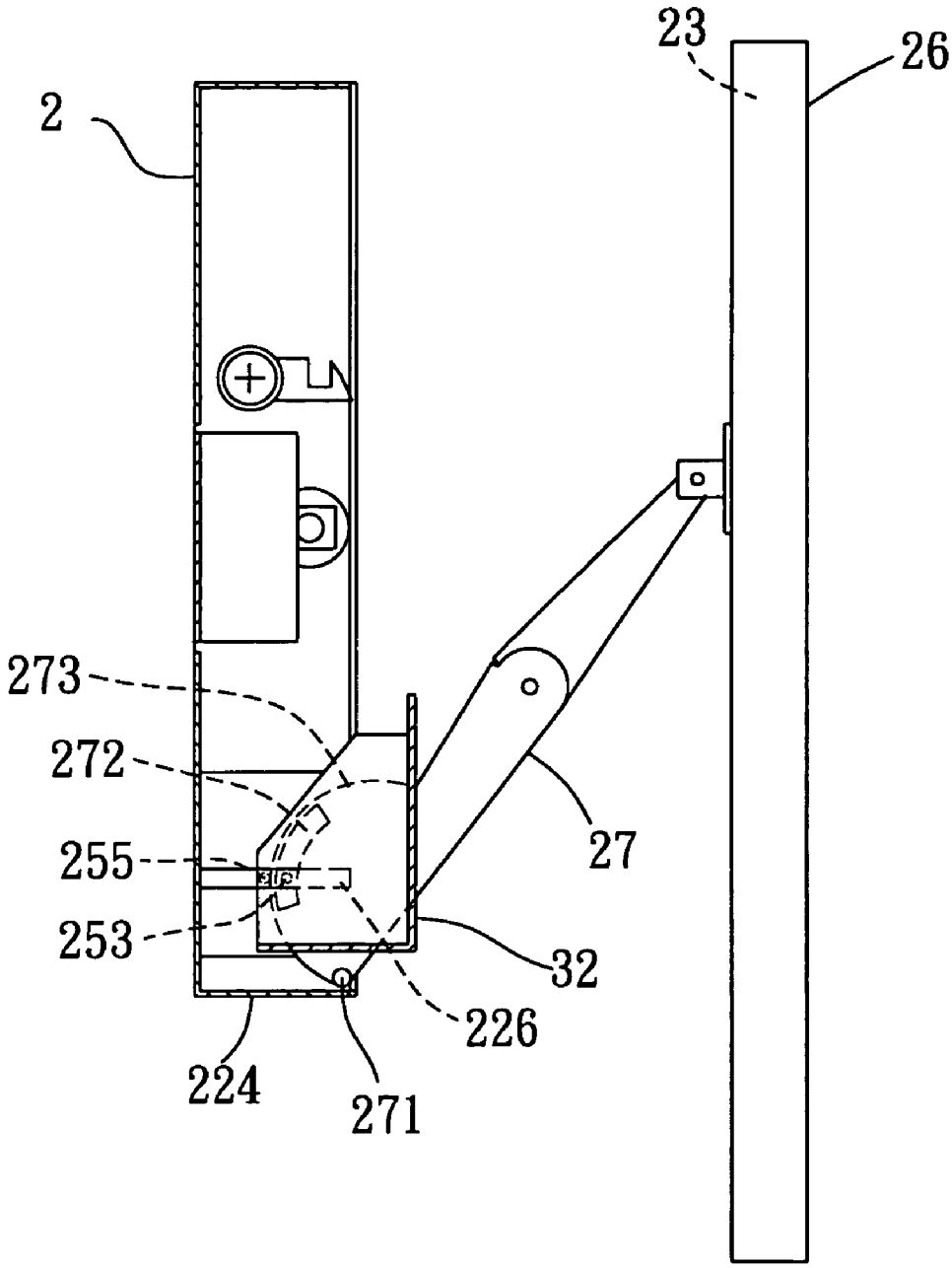
FIGS. 20 and 21 are sectional side views of the fourth preferred embodiment in an opened state.
Figure 21:
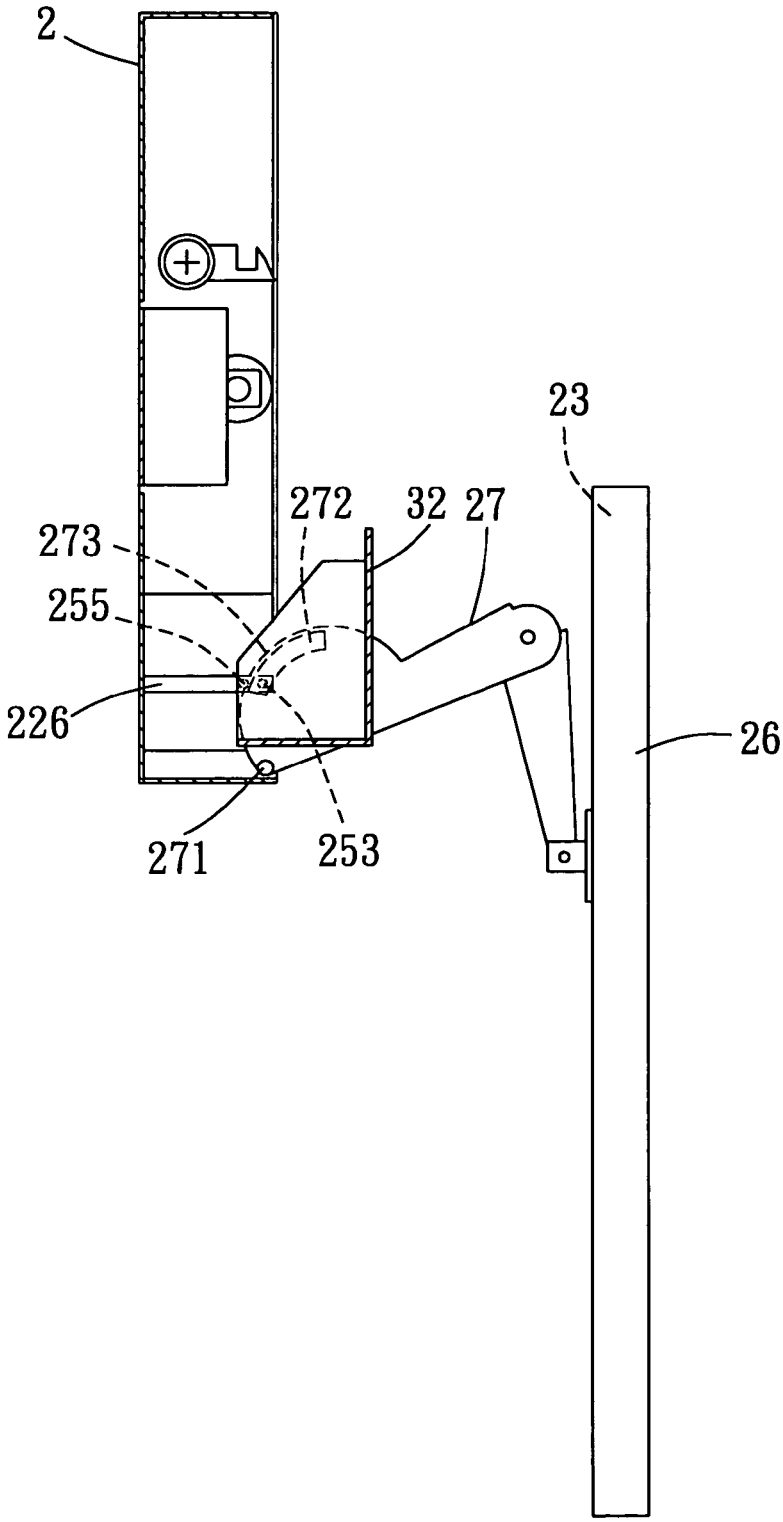

Referring to FIGS. 19 to 21, the fourth preferred embodiment of a display frame according to this invention is shown to be similar to the previous embodiments, except that the linkage 27 of each linking units includes two levers pivoted to each other. One of the levers has a connecting end 273 which is formed with an arcuate slot 272 to engage the coupling end of the key 253 that is inserted slidably into the keyway 226. As such, the key 253 is slidable along the arcuate slot 272 when the connecting end 273 is angularly moved between the first and second positions, thereby shifting the holding tray 32 between the extending and retreat positions. This lever further has a joint end 271 which is mounted pivotally on the lower wall of the frame body 2 about a second pivoting axis and which is angularly displaced from the arcuate slot 272 so as to stabilize the angular movement of the connecting end 273. Preferably, another key 255 is disposed on the holding tray 32 and is slidable along an outside of the arcuate slot 272.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A display frame adapted for holding a framed picture and a flat panel device having a bottom wall and for mounting to a support, said display frame comprising:

a frame body including a rear wall, and right and left walls which extend in an upright direction and which are disposed opposite to each other in a longitudinal direction transverse to the upright direction to define a receiving space therebetween, said receiving space having an access opening which is opposite to said rear wall in the transverse direction and which faces forwardly and in a transverse direction relative to the upright and longitudinal directions;

a backing member which is adapted for holding the flat panel device, which is received in said receiving space, and which is movable relative to said rear wall of said frame body in the transverse direction;

a front profile frame having a viewing window, and disposed to be movable relative to said frame body between an open position, where said viewing window is remote from said access opening to permit placement of the flat panel device to said backing member, and a closed position, where said viewing window is close to said access opening so as to cover said access opening;

a biasing member disposed to bias said backing member away from said rear wall;

a holding tray which is disposed underneath said backing member, and which is movable relative to said frame body in the transverse direction between an extending position, where said holding tray extends forwardly and outwardly of said access opening, and a retreat position, where said holding tray retreats into said receiving space; and a linking unit which is disposed to link said front profile frame and said holding tray such that when said front profile frame is in the open position, said holding tray is in the extending position, and such that when said front profile frame is in the closed position, said holding tray is in the retreat position.

2. The display frame of claim 1, wherein said linking unit includes:

a pivot mount mounted on said front profile frame and extending to terminate at an anchor end which is distal from said viewing window, and a linkage having a pivot end which is pivotally mounted on said anchor end of said pivot mount about a pivot axis, and a connecting end which is opposite to said pivot end in a radial direction relative to the pivot axis and which is turnable between first and second positions that correspond to the open and closed positions, respectively, said display frame further comprising:

a keyway formed in one of said right and left walls and elongated in the transverse direction;

a key disposed on said holding tray, and having an intermediate portion extending from said holding tray in the longitudinal direction to terminate at a coupling end, said intermediate portion being inserted into and being slidable relative to said keyway so as to move said holding tray between the extending and retreat positions; and a coupling member disposed to couple said connecting end of said linkage with said coupling end of said key such that when said connecting end of said linkage is moved between the first and second positions, said holding tray is moved between the extending and retreat positions, respectively.

3. The display frame of claim 2, wherein said connecting end of said linkage has an inner peripheral bearing wall for journaling of said coupling end of said key thereon so as to serve as said coupling member, said front profile frame having a proximate end which is mounted pivotally to said frame body about a first pivoting axis so as to stabilize angular movement of said connecting end of said linkage, and a distal end which is at the opposite side of said viewing window relative to said proximate end, and which is turnable about the first pivoting axis to close said access opening in the closed position.

4. The display frame of claim 3, wherein said pivot mount is disposed proximate to said proximate end.

5. The display frame of claim 2, wherein said connecting end of said linkage has an arcuate slot which engages said coupling end of said key, and which is configured to permit sliding of said coupling end of said key therealong when said connecting end of said linkage is angularly moved between the first and second positions, thereby shifting said holding tray between the extending and retreat positions, said linkage further having a joint end which is mounted pivotally on said frame body about a second pivoting axis and which is angularly displaced from said arcuate slot so as to stabilize angular movement of said connecting end of said linkage.

6. The display frame of claim 2, wherein said holding tray includes a front barrier wall which confronts and which is disposed distal from said rear wall, said backing member including a lower abutment portion which is spaced apart from said front barrier wall in the transverse direction, and which is slidable on said holding tray so as to adjust a distance between said lower abutment wall and said front barrier wall so as to accommodate the bottom wall of the flat panel device and so as to be adapted to permit abutment of the flat panel device thereagainst;

said biasing member being disposed between said rear wall and said backing member so as to bias said lower abutment portion of said backing member towards said front barrier wall, thereby retaining the bottom wall of the flat panel device between said lower abutment portion and said front barrier wall.

7. The display frame of claim 6, further comprising a fastening unit which includes:

a baseplate adapted to be secured on the support, and having right and left ends which are disposed proximate to said right and left walls, respectively, right and left arms which extend respectively from said right and left ends of said baseplate in the transverse direction, and which confront said right and left walls in the longitudinal direction, respectively, a right interengaging member interengaging said right arm and said right wall, and configured to permit movement of said right wall relative to said right arm in the transverse direction, and a left interengaging member interengaging said left arm and said left wall, and configured to permit movement of said left wall relative to said left arm in the transverse direction.

8. The display frame of claim 7, wherein each of said right and left interengaging members includes a retained portion which is retainingly slidable relative to a respective one of said right and left arms, and a ball joint, each disposed opposite to said retained portion in the transverse direction and which engages a respective one of said right and left walls so as to permit turning of said frame body relative to said baseplate.

9. The display frame of claim 8, wherein said fastening unit further includes an intermediate plate which extends in the longitudinal direction, and which interconnects said right and left arms, said intermediate plate being disposed forwardly of and being mounted pivotally on said baseplate about a rotating axis in the transverse direction such that said right and left arms are turnable about the rotating axis relative to said baseplate so as to permit turning of said frame body relative to the support.

10. The display frame of claim 7, wherein each of said right and left interengaging members is a latch-and-latch hole assembly.

11. The display frame of claim 6, further comprising a transparent sheet disposed forwardly of and spaced apart from said backing member to confine therebetween an inserting space for receiving the framed picture.

12. The display frame of claim 1, further comprising a locking unit disposed to releasably fasten said front profile frame to said frame body in the closed position.

* * * * *